US005931462A

United States Patent [19]

Delfosse

[11] Patent Number: 5,931,462

[45] Date of Patent: Aug. 3, 1999

[54] METHOD OF SHEET ROTATION AND A SHEET STACKER WITH A SHEET ROTATOR

[75] Inventor: Christian Delfosse, Liernu, Belgium

[73] Assignee: C.P. Bourg S.A., Ottiginies-Louvain L.N, Belgium

[21] Appl. No.: 08/872,993

[22] Filed: Jun. 11, 1997

[30] Foreign Application Priority Data

Jun. 17, 1996 [EP] European Pat. Off. ..... 96109712
Sep. 6, 1996 [EP] European Pat. Off. ..... 96114317

[51] Int. Cl.[6] ..... B65H 7/02

[52] U.S. Cl. ..... 271/228; 271/261; 271/265.03; 271/184

[58] Field of Search ..... 271/184, 225, 271/227, 228, 261, 265.03

[56] References Cited

U.S. PATENT DOCUMENTS

| | | | |
|---|---|---|---|
| 3,758,104 | 9/1973 | Daily . | |
| 4,155,440 | 5/1979 | Bodanski et al. . | |
| 4,971,304 | 11/1990 | Lofthus . | |
| 5,078,384 | 1/1992 | Moore | 271/228 |
| 5,090,683 | 2/1992 | Kamath et al. | 271/184 X |
| 5,169,140 | 12/1992 | Wenthe, Jr. | 271/228 |
| 5,732,943 | 3/1998 | Delfosse | 271/228 |

FOREIGN PATENT DOCUMENTS

| | | | |
|---|---|---|---|
| 0 469 866 | 2/1992 | European Pat. Off. . | |
| 0 512 827 | 11/1992 | European Pat. Off. . | |
| 0 536 885 | 4/1993 | European Pat. Off. . | |
| 58-167340 | 10/1983 | Japan . | |
| 61-222626 | 10/1986 | Japan | 198/456 |
| 3-128842 | 5/1991 | Japan | 271/228 |
| 3-267244 | 11/1991 | Japan | 271/228 |

OTHER PUBLICATIONS

Patent Abstracts of Japan vol.008,No. 005(M–267), Jan. 11, 1984, & JP 58 167340 A (Ricoh KK), Oct. 3, 1983, *abstract*.

Patent Abstracts of Japan, Publication No. 07257799, Oct. 9, 1995, European Patent Office.

Patent Abstracts of Japan, Publication No. JP57195055, Nov. 30, 1982, European Patent Office.

Raymond W. Huggins, "SKEW Detector and Method of Correction", Xerox Disclosure Journal, vol. 14, No. 1, Jan./Feb. 1989, pp. 23–24.

*Primary Examiner*—Boris Milef

*Attorney, Agent, or Firm*—Sixbey, Friedman Leedom & Ferguson; Gerald J. Ferguson, Jr.; Stuart J. Friedman

[57] ABSTRACT

To produce a desired sheet orientation between upstream and downstream positions of a sheet path along which sheets travel successively in a predetermined sheet travel direction, each sheet is driven uniformly along the path with an intermediate phase in which the sheet is driven differentially to rotate the sheet without changing its velocity component in the sheet travel direction. If the sheet has a skew or an offset error, the amount of rotation and its starting point are adjusted appropriately to compensate for both.

11 Claims, 7 Drawing Sheets

METHOD OF SHEET ROTATION AND A SHEET STACKER WITH A SHEET ROTATOR

The present invention relates to a method of sheet rotationto change sheet orientation between upstream and downstream positions of a sheet path along which sheets travel successively in a predetermined sheet travel direction, and to a sheet stacker with a sheet rotation device operating in accordance with the method.

Sheets delivered individually by a printing or copying machine may be received with either of two mutually perpendicular orientations, depending on the particular type of machine or printing job. In addition, the sheets may have a random registration error combined with a random skew error. When the sheets are to be collected for further processing, for example in a booklet binder or in a stacker, they need to be properly oriented and aligned.

U.S. Pat. No. 4,971,304 discloses an active sheet registration system which provides deskewing and registration of sheets. This system uses a sheet rotator with a pair of laterally spaced sheet driving wheels which drive the sheet differentially to rotate the sheet in opposite directions. During a first period of time a sheet is driven differentially to both compensate for an initial random skew and induce an alignment skew of a predetermined magnitude and direction. During a second period of time, the sheet is driven differentially to compensate for the alignment skew and deskew the sheet, whereby one edge of the sheet is side registered to a lateral position transverse of the general sheet travel direction.

Rotation of a sheet to change its orientation, e.g. between portrait and landscape, however, is not conceivable with this sheet rotator since a 90° rotation is required and the sheet rotator has a limited capability of sheet rotation.

A 90° sheet rotation can be achieved with the sheet rotator disclosed in EP 0 536 885 A1. This sheet rotator has a pair of laterally spaced sheet driving wheels which are driven in opposite directions. While the sheets are reliably and gently rotated by the required 90°, the sheet flow is interrupted since the sheets must be stopped when they arrive at the driving wheels.

The present invention provides a method of sheet rotation which is capable of rotating by 90° or more sheets arriving at high speed in a continuous flow without interrupting or even retarding the flow of sheets. Simultaneously, any misalignment or registration error of the sheets can be corrected.

According to the invention, a method of sheet rotation to change sheet orientation from one of two mutually perpendicular orientations to the other between upstream and downstream positions of a sheet path is provided. The sheets travel successively along the sheet path in a predetermined sheet travel direction.

Each sheet is driven uniformly between the upstream and downstream positions with an intermediate driving phase where the sheet is driven differentially without altering its velocity component in the sheet travel direction. Preferably, the sheet is driven in the intermediate driving phase with a velocity versus time profile composed of a first velocity function wherein the driving speed is momentarily increased by a predetermined amount and a second velocity function wherein the driving speed is momentarily reduced by the same predetermined amount and at the same time as the driving speed is momentarily increased in the first velocity function, the amount of sheet rotation being determined by the duration of the increased and reduced driving velocities.

In the preferred embodiment, the sheet is rotated about a center of rotation which is determined by selecting the ratio between the velocity vectors of the first and second velocity functions. Further, when a sheet offset is to be generated simultaneously with rotation of the sheet, the amount of sheet offset is determined by selecting the point in time at which sheet rotation is started from the moment of sheet arrival at a fixed reference on the sheet path.

Surprisingly, the sheets must neither be stopped nor even slowed down when they arrive at the differentially driven driving rollers so that the flow of sheets remains continuous. Therefore, an increased spacing between the sheets is not required.

In accordance with an advantageous feature of the invention, a linear optical detector is used which extends in a direction transverse to the sheet travel direction to derive information on the sheet length and on the sheet registration error. Although the linear optical detector only senses a limited width of the sheet when the sheet passes over the detector, the detector output contains all required information on any initial skew error and side registration error of the sheet. These parameters can be calculated from the detector output using a microcomputer, based on elementary geometrical relationships. Generally, the particular format of the sheets processed is known. However, the sheet detector can also be used to determine the length of a sheet. In addition to a 90° rotation, the sheet is rotated by an amount determined to compensate for any skew error.

The invention also provides a sheet stacker which comprises a sheet stacking table, a sheet input where individual sheets are successively received with a predetermined orientation, and a sheet rotating device which operates in accordance with the above method. The rotator comprises a sheet path along which the sheets travel successively in a predetermined sheet travel direction and a pair of sheet driving wheels spaced from each other transversely to the sheet travel direction. Each wheel is motorized by a step motor directly coupled thereto. The step motors are energized to drive the sheet with a driving velocity versus time profile adapted to produce the desired sheet rotation. Preferably, the driving velocity versus time profile includes a phase of sheet rotation to compensate for a skew error of the sheet. The stacker further comprises a sheet transferring and depositing device which receives the sheets from the sheet rotator with the target orientation and deposits the sheets on the stacking table. For the sheet transferring and depositing device, a rotary sheet clamp is preferably used. A rotary sheet clamp is capable of depositing a sheet on the stacking table without introducing any substantial registration error and without inducing static electricity.

Further details and advantages of the present invention will become apparent from the following description in conjunction with the accompanying drawings wherein.

Figure 6A:
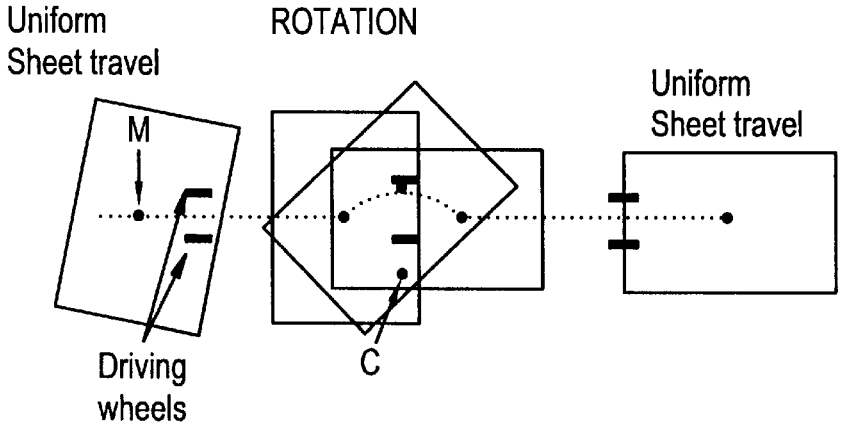
Figure 6B:
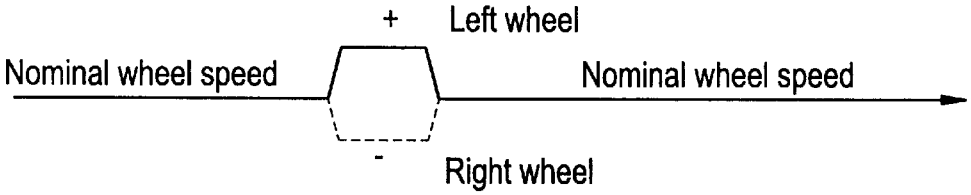
Figure 6C:
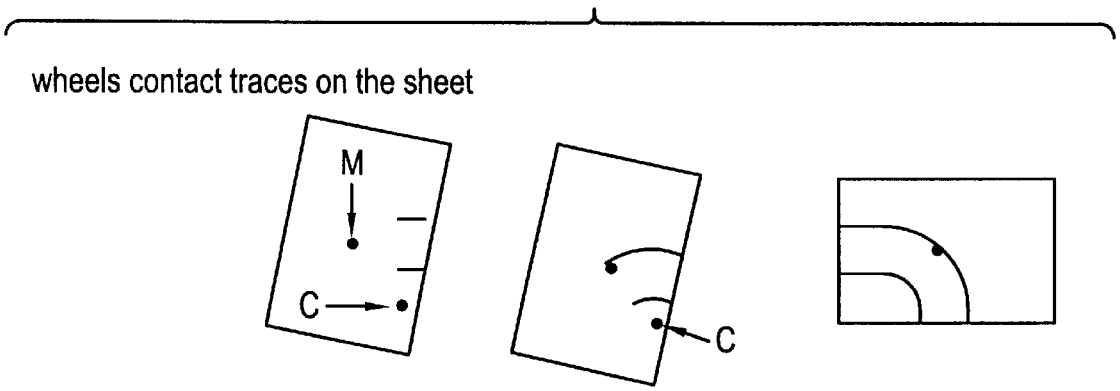
Figure 7A:
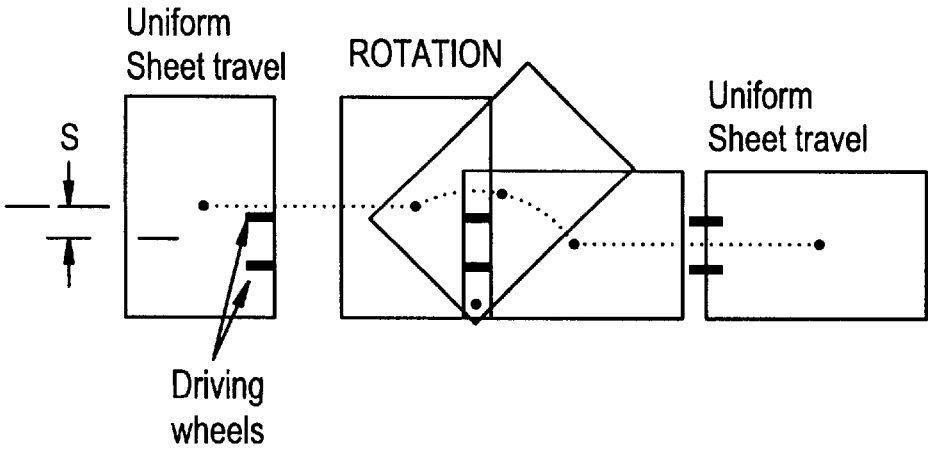
Figure 7B:
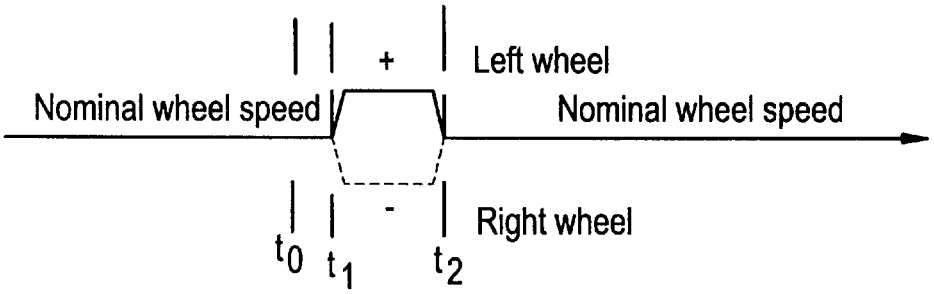
Figure 7C:
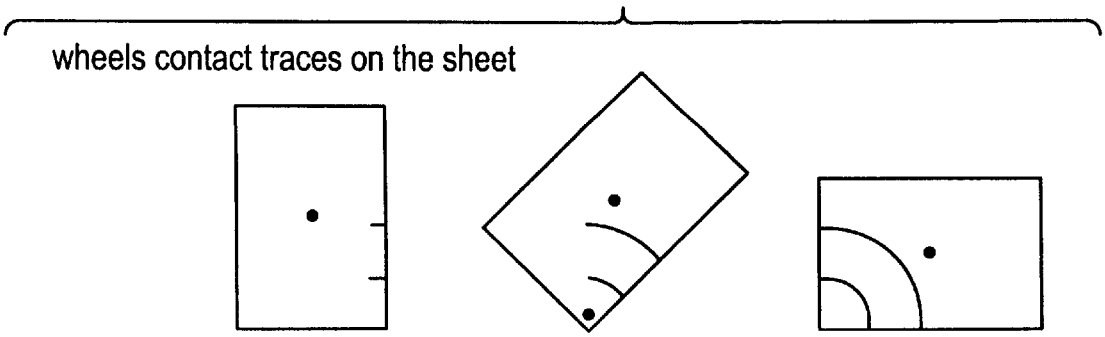
Figure 8:
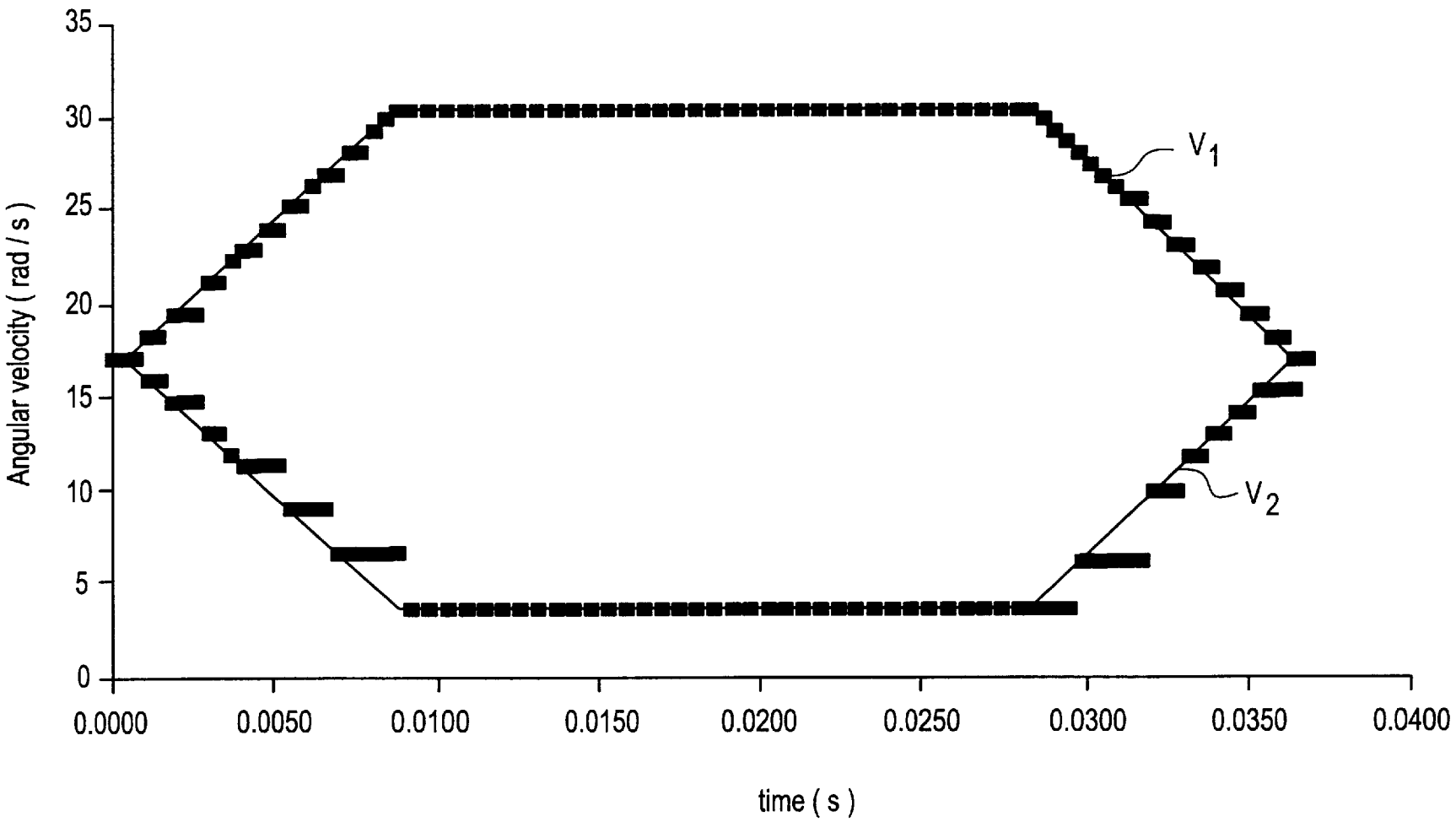

FIGS. 3(*a*), 3(*b*), 4(*a*), and 4(*b*) illustrate the principles of a vision system for deriving sheet registration error parameters;

FIGS. 5(*a*), 5(*b*), and 5(*c*) illustrate the operation of the sheet rotator to rotate a sheet without offset or skew correction;

FIGS. 6(*a*), 6(*b*), and 6(*c*) illustrate operation of the sheet rotator to rotate a sheet and simultaneously correct a skew error;

FIGS. 7(*a*), 7(*b*), and 7(*c*) illustrate the operation of the sheet rotator to rotate a sheet and simultaneously correct an offset error; and FIG. 8 shows the velocity versus time profile in the phase of sheet rotation.

Figure 1:
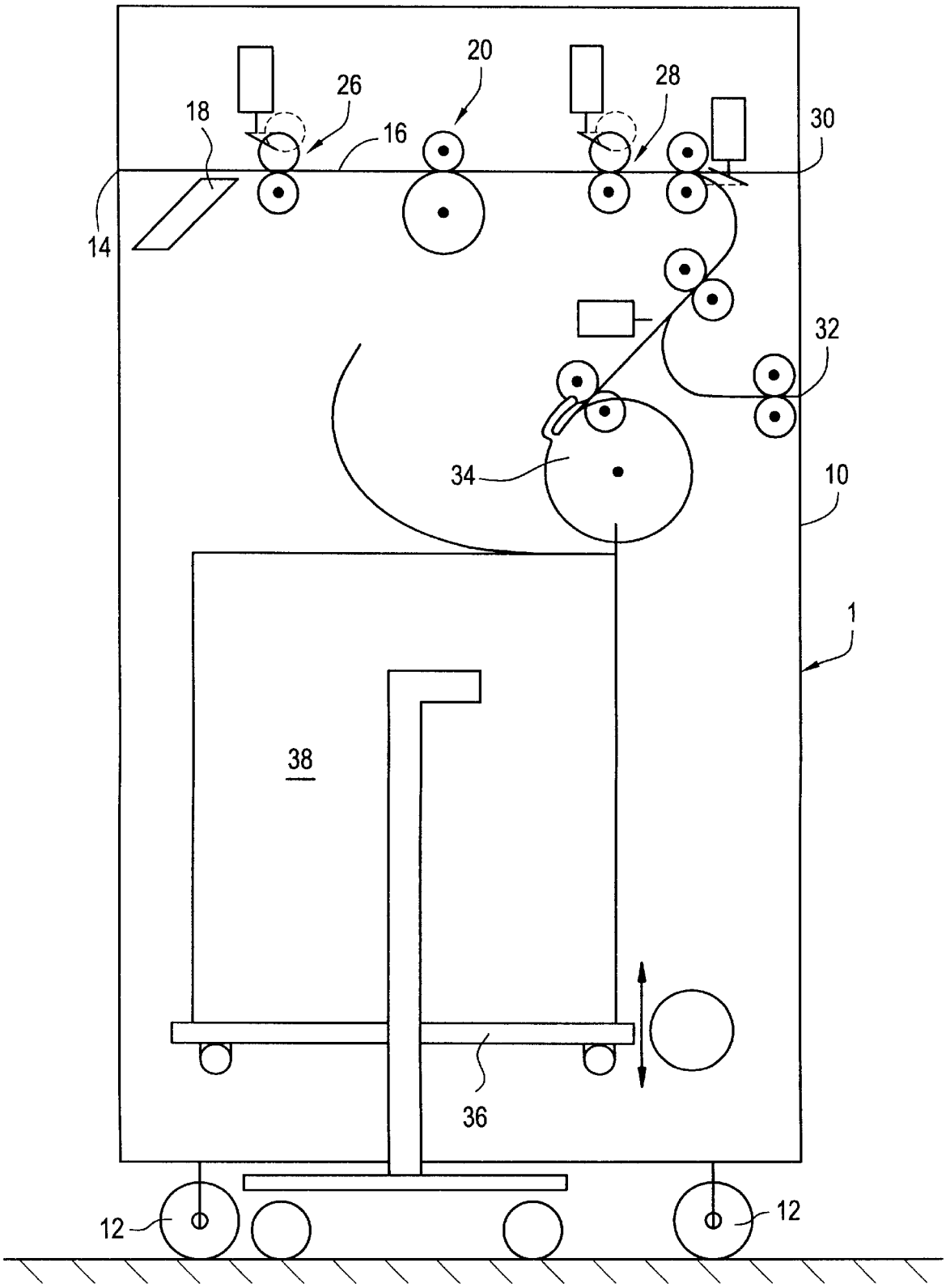
FIG. 1 is a schematic sectional view of a sheet stacker.

Referring now to FIG. 1 of the drawings, a sheet stacker 1 includes a machine frame 10 mounted on castors 12. On its front side, the machine frame 10 has a sheet inlet 14, and a horizontal sheet travel path 16 extends from sheet inlet 14. An optical scanner 18 which may comprise a linear optical detector array, is arranged below the sheet travel path 16 close to sheet inlet 14. A sheet rotator generally indicated at 20 is provided on the sheet travel path 16. The sheet rotator 20 comprises a pair of laterally spaced sheet driving wheels 22, 24 (see FIG. 2) arranged below the sheet travel path 16 and a pair of correspondingly laterally spaced counterwheels 22*a*, 24*a*. Upstream and downstream from the sheet rotator 20 are driving roller pairs 26 and 28, the upper roller of which can be selectively lifted. Downstream from the sheet rotator, the sheets are selectively gated to a first sheet outlet 30 which is horizontally aligned with sheet inlet 14, to a second sheet outlet 32 on a level lower than that of sheet outlet 30, or to a rotary sheet clamp 34. A vertically moveable slacking table 36 is provided at the bottom of machine frame 10. As shown in FIG. 1, sheets received by the rotary clamp 34 from the sheet rotator 20 are deposited on a stack 38 of sheets accumulated on the stacking table 36. The rotary clamp 34 is able to deposit the sheets on the stack 38 without introducing any substantial registration error and without inducing static electricity.

Figure 2:
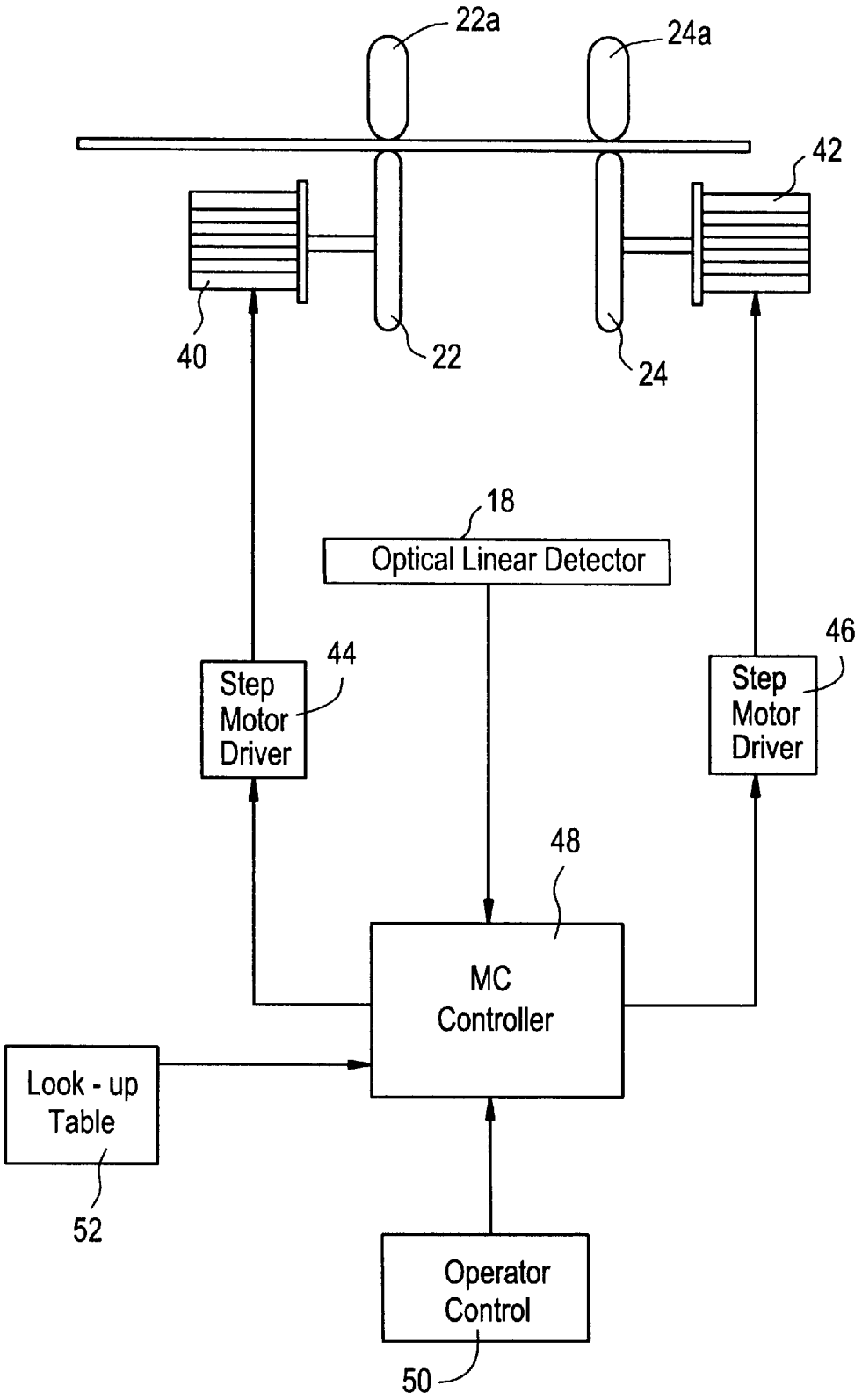
FIG. 2 is a schematic view of a sheet rotator and associated control circuitry used in the sheet stacker.

As seen in FIG. 2, each of the driving wheels 22, 24 is directly coupled to an associated step motor 40, 42. Step motors 40, 42 are connected to step motor drivers 44, 46, respectively, which are both connected to a microcomputer controller 48. An operator control panel 50 can be connected to controller 48, as shown. Also seen in FIG. 2 is a programmable memory 52 forming a lookup table which is connected to controller 48. The purpose of the lookup table will become apparent from the following description of the inventive method. A further input to the controller 48 is provided by the optical scanner 18.

Figure 3A:
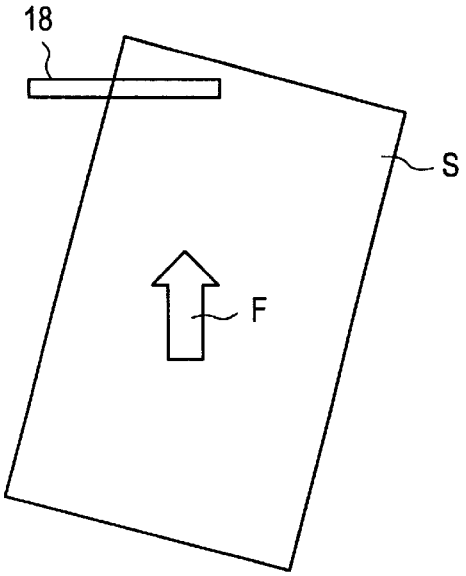
Figure 4A:
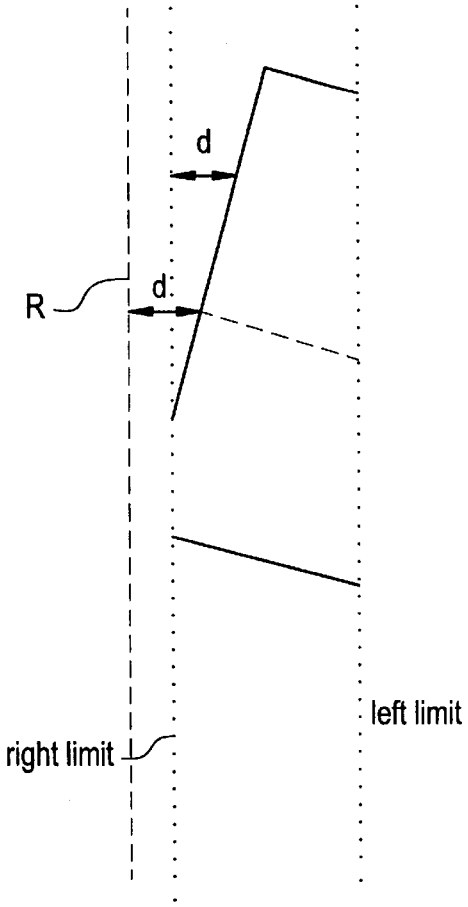
Figure 3B:
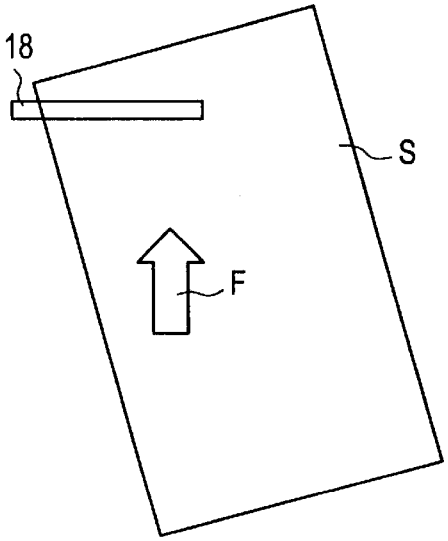
Figure 4B:
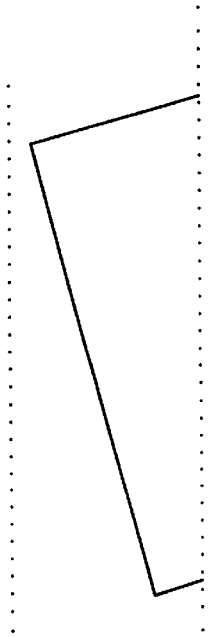

Referring now to FIG. 3*a*, when a sheet S is received at sheet inlet 14 in the general sheet travel direction indicated by an arrow F, it passes over optical scanner 18, the output of which is provided to controller 48. Optical scanner 18 senses only a fraction of the width of each sheet. Therefore, as seen in FIG. 4*a*, the optical scanner 18 can "see" only a portion of the sheet edges. Normally, each sheet will be received with a random angle of skew with respect to the travel direction F, and with a random side offset d with respect to a lateral reference line R of the sheet travel path. If the size of the sheet is known, it is easy for controller 48 to derive from the output of optical scanner 18 the sheet registration error, i.e. the skew error $\alpha$ and the side registration error d. The controller 48 uses elementary geometrical relationships to derive these error parameters from the output of optical scanner 18. In FIGS. 3*b* and 4*b* the sheet S has an angle of skew in a sense opposite to that in FIGS. 3*a* and 4*a*, and two corners of the sheet are "seen" by the optical scanner 18, although this is not a requirement.

Figure 5A:
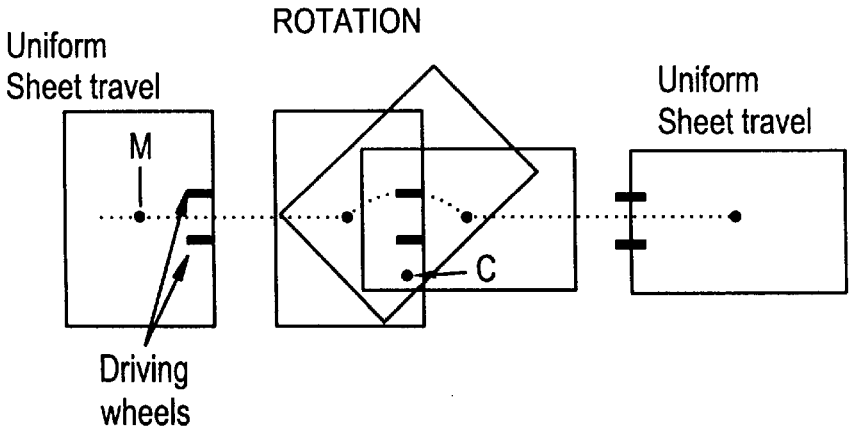
Figure 5B:
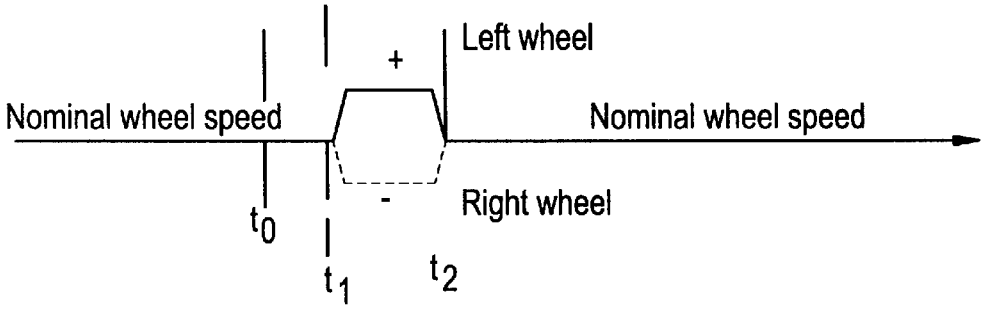
Figure 5C:
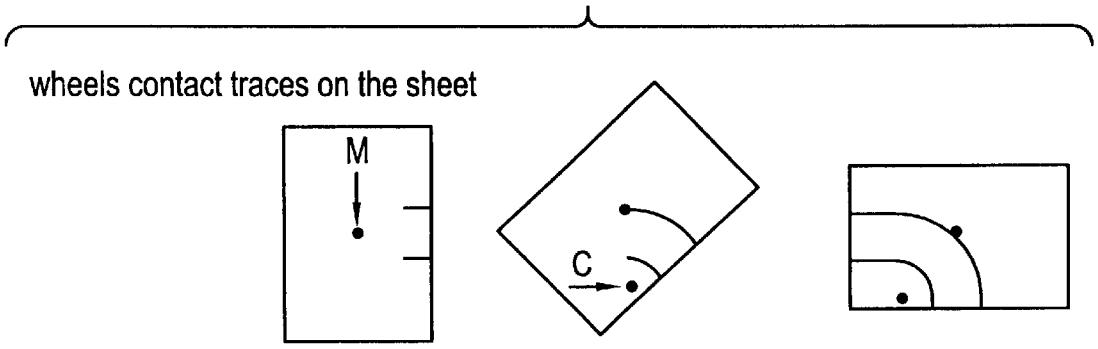

With reference to FIG. 5, travel of a sheet is illustrated from an upstream position close to sheet inlet 14 to a downstream position close to sheet outlet 30. The relative position of the driving wheels 22, 24 on the sheet is represented by a pair of laterally spaced dark lines in FIG. 5*a*. FIG. 5*b* shows the velocity versus time profile at the driving wheels 22, 24. It is composed of two velocity functions, one for each wheel. Finally, the traces of the contact point of wheels 22, 24 on the sheet are marked in FIG. 5*c*. Also apparent in FIGS. 5*a* and 5*c* are the center M of the sheet and the center C of rotation of the sheet. The center C of rotation of the sheet lies on the common axis of the driving wheels and outside of the space between these wheels at a distance which is determined by the ratio of their velocity vectors.

When there is no sheet offset and no skew error to be corrected, as in the case of FIG. 5, a 90° rotation of the sheet is required to change its orientation, e.g. from portrait to landscape, as in FIG. 5. In order to generate a 90° rotation of the sheet, the driving rollers 22, 24 are momentarily driven at different speeds. More specifically, as seen in the diagram of FIG. 5*b*, the velocity of the wheel on the left-hand side in the direction of travel is momentarily accelerated by the same amount as the driving wheel on the right-hand side is slowed down. In the diagram, the continuous line refers to the driving wheel on the left-hand side, and the chained line refers to the wheel on the right-hand side. Details of this first phase of differential driving will be explained later with reference to FIG. 8.

The amount of rotation is determined by the duration of the intermediate differential driving phase between times $t_1$ and $t_2$ in FIG. 5*b*, assuming a constant difference between the driving velocities of the wheels 22, 24 during this phase. As will be seen later in the discussion of FIG. 7, the starting point $t_1$ of the differential driving phase must be appropriately selected with respect to a fixed reference to adjust the target offset of the sheet after its rotation.

In order to permit free rotation of the sheet, the upper driving rollers 26 and 28 are momentarily lifted. The driving rollers 26, 28 are only required if relatively short sheets are to be handled. In fact, the total length of the horizontal sheet travel path 16 is not much more than the length of the longest sheet to be handled, for example not more than 200 or, preferably, 150 millimeters.

When the sheet is received with a skew error, as shown in FIG. 6, a rotation of more or less than 90° is required. E.g., in FIG. 6, the sheet is tilted at an angle of about 10°, and an 80° rotation is required. Accordingly, the duration of the intermediate differential driving phase between $t_1$ and $t_2$ is slightly reduced, assuming a constant velocity difference.

In the case of FIG. 7, the sheet has its center M shifted by an amount S with respect to its center M after a 90° rotation. To generate a sheet offset in the amount of S, the point in time $t_1$ where the differential driving phase begins is appropriately selected with respect to a fixed reference. The fixed reference can be a time $t_0$ where the leading edge of the sheet passes over a sheet detector at a fixed location on the sheet path adjacent the driving rollers 22, 24. As seen in FIG. 7*b*, the period of time between $t_0$ and $t_1$ is relatively shorter than the corresponding period in FIG. 5. In FIG. 7*c* or 5*c*, this period is reflected by the length of straight sections of the wheel contact traces on the sheet.

To achieve registration with high accuracy, the incremental steps of motors 40, 42 should be small, and a high-speed controller 48 is required. To reduce the performance requirements on the controller 48, the lookup table 52 (FIG. 2) is used. The lookup table 52 contains a programmed table of timing data for control of the step motor drivers 44, 46 in dependence upon the required sheet rotation and offset to be achieved.

The diagram in FIG. 8 illustrates in more detail the phase of sheet rotation. The diagram shows a velocity profile, i.e. a diagram showing the angular velocity $v_1$ for the first driving wheel 22 and the angular velocity $v_2$ for the second driving wheel 24 as a function of time. Since the driving motors 40 and 42 used are step motors, the velocity profile cannot be continuous, and is actually composed of discrete incremental steps. To avoid a tilting movement of the sheet during rotation, i.e. to make rotation substantially monotonous, the incremental steps of both motors are synchronized to the extent possible.

The particular velocity profile of FIG. 8 consists of a first part where the velocity $v_1$ is rising and the velocity $v_2$ is decreasing, a second part where the velocities $v_1$ and $v_2$ are different but constant, and a third part where the velocity $v_1$ decreases and the velocity $v_2$ increases. Throughout the first, second and third parts of this profile, the sheet is driven "differentially", i.e. the driving wheels 22, 24 rotate at different speeds so that the sheet is rotated.

If desired, the sheets on stacking table 36 can be stacked with a lateral registration differing after a preselected number of sheets, to provide so-called offset jobs.

I claim:

1. A method of sheet rotation performed by a sheet rotation device to change sheet orientation from one of two mutually perpendicular orientations to the other between upstream and downstream positions of a sheet path along which sheets travel successively in a predetermined sheet travel direction, comprising the steps of:

driving a sheet uniformly between said upstream and downstream positions;

providing an intermediate driving phase in which the sheet is driven differentially without altering its velocity component in the sheet travel direction;

generating a sheet offset;

said sheet being driven in said intermediate driving phase with a velocity versus time profile composed of a first velocity function wherein the driving speed is momentarily increased by a predetermined amount and a second velocity function wherein the driving speed is momentarily reduced by the same predetermined amount and at the same time as the driving speed is momentarily increased in the first velocity function, the amount of sheet rotation being determined by the duration of the increased and reduced driving velocities, wherein said sheet offset is generated simultaneously with rotation of the sheet and is determined by selecting the point in time at which sheet rotation is started from the moment of sheet arrival at a fixed reference on the sheet path.

2. The method of claim 1, wherein said sheet is rotated about a center of rotation which is determined by selecting the ratio between the velocity vectors of the first and second velocity functions.

3. The method of claim 1, wherein sheet rotation is at least substantially monotonous.

4. The method of claim 1, wherein any sheet registration error at said upstream position is detected and the sheet is driven in said intermediate driving phase with a velocity versus time profile determined to correct said registration error.

5. The method of claim 1, wherein the sheets are driven between the upstream and downstream positions by a pair of wheels spaced from each other transversely to the sheet travel direction, each pair of wheels being motorized by a step motor directly coupled thereto.

6. The method of claim 5, wherein the step motors are energized with incremental steps which are substantially synchronized between the motors.

7. The method of claim 1, wherein a linear optical detector extending in a direction transverse to the sheet travel direction is used to derive information on the sheet length and on the sheet registration error.

8. A sheet stacker comprising a sheet stacking table, a sheet input where individual sheets are successively received with a predetermined sheet orientation, and a sheet rotation device operating in accordance with the method of any of claims 2, 3, 4, 7 or 1 to change the orientation of said sheets, said sheet stacker comprising:

said sheet travel path along which the sheets travel successively in a predetermined sheet travel direction;

a sheet transferring and depositing device receiving the sheets from the sheet rotating device and depositing the sheets on the stacking table; and wherein said sheet rotation device comprises a pair of sheet driving wheels spaced from each other transversely of the sheet travel direction, each wheel being motorized by a step motor directly coupled thereto, said step motors being energized to drive the sheet with said velocity versus time profile.

9. The sheet stacker of claim 8, wherein said sheet transferring and depositing device comprises a rotary sheet clamp.

10. The sheet stacker of claim 8, further comprising a pair of driving rollers upstream of said pair of wheels and a pair of driving rollers downstream of said pair of wheels, each pair of driving rollers having one roller that is selectively retracted from the other when a sheet is differentially driven by said pair of wheels.

11. The sheet stacker of claim 8, wherein said sheet travel path has a total length exceeding the length of the longest possible sheet to be handled by not more than about 20 cm.

* * * * *